US012352131B2

(12) United States Patent
Fripp et al.

(10) Patent No.: US 12,352,131 B2
(45) Date of Patent: Jul. 8, 2025

(54) RESTRICTOR AND BRIDGE VALVE FOR RESTRICTING WATER AND PRODUCING GAS

(71) Applicant: Halliburton Energy Services, Inc., Houston, TX (US)

(72) Inventors: Michael Linley Fripp, Singapore (SG); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/463,574

(22) Filed: Sep. 8, 2023

(65) Prior Publication Data

US 2025/0084730 A1 Mar. 13, 2025

(51) Int. Cl.
*E21B 34/08* (2006.01)

(52) U.S. Cl.
CPC ..... *E21B 34/08* (2013.01); *E21B 2200/05* (2020.05)

(58) Field of Classification Search
CPC ..... E21B 34/08; E21B 2200/05
See application file for complete search history.

(56) References Cited

U.S. PATENT DOCUMENTS

| | | | | |
|---|---|---|---|---|
| 9,366,108 | B2 | 6/2016 | Aakre et al. | |
| 9,624,759 | B2 * | 4/2017 | Mathiesen | E21B 43/122 |
| 10,605,062 | B2 | 3/2020 | Voll et al. | |
| 10,871,057 | B2 | 12/2020 | Chochua et al. | |
| 11,041,361 | B2 | 6/2021 | Fripp et al. | |
| 11,280,168 | B2 | 3/2022 | Greci et al. | |
| 2014/0216733 | A1 * | 8/2014 | Mathiesen | E21B 43/32 166/252.5 |
| 2016/0273321 | A1 | 9/2016 | Frosell et al. | |
| 2020/0378215 | A1 | 12/2020 | Brown et al. | |
| 2020/0408066 | A1 | 12/2020 | Mathiesen et al. | |
| 2021/0062615 | A1 * | 3/2021 | Fripp | E21B 34/08 |
| 2022/0195850 | A1 | 6/2022 | El Mallawany et al. | |

FOREIGN PATENT DOCUMENTS

CN 105927188 9/2016

OTHER PUBLICATIONS

"PCT Application No. PCT/US2023/073903, International Search Report and Written Opinion", May 22, 2024, 9 pages.

* cited by examiner

*Primary Examiner* — Taras P Bemko
(74) *Attorney, Agent, or Firm* — DeLizio, Peacock, Lewin & Guerra, LLP

(57) ABSTRACT

Some implementations include a flow control device positioned in a tubing string within a wellbore formed in a subsurface formation, the flow control device configured to produce a liquid or a gas. The flow control device may comprise a movable restrictor configured to move, in response to the liquid at a first velocity from the subsurface formation, from a closed position to an open position and a pilot-operated valve configured to attenuate a flow of the liquid through the flow control device when the movable restrictor is in the open position.

20 Claims, 4 Drawing Sheets

RESTRICTOR AND BRIDGE VALVE FOR RESTRICTING WATER AND PRODUCING GAS

TECHNICAL FIELD

The disclosure generally relates to wellbore tools in subsurface formations, and in particular, flow control devices in producing gas wells.

BACKGROUND

Water influx may cause issues in hydrocarbon-producing wells, specifically gas wells. Gas producing wells are not as efficient when water breaks through to the completion tubing. Slowing the production of water upon breakthrough autonomously may be a way to increase the life and productivity of a gas producing well.

BRIEF DESCRIPTION OF THE DRAWINGS

Implementations of the disclosure may be better understood by referencing the accompanying drawings.

DESCRIPTION OF SOME EXAMPLE IMPLEMENTATIONS

The description that follows includes example systems, methods, techniques, and program flows that embody implementations of the disclosure. However, it is understood that this disclosure may be practiced without these specific details. In other instances, well-known instruction instances, protocols, structures, and techniques have not been shown in detail in order not to obfuscate the description.

Overview

Autonomous flow control devices may be particularly advantageous in subterranean operations, since they are able to automatically regulate fluid flow without the need for operator control due to their design. In this regard, autonomous flow control devices may be designed such that they provide a greater resistance to the flow of undesired fluids (e.g., liquids, water) than they do desired fluids (e.g., gas), particularly as the percentage of the undesired fluids increases.

To minimize water breakthrough autonomously in gas wells, a gas producer/water restrictor device may be configured to preferentially produce gas and restrict water production. This separation may occur autonomously based on the fluid type entering the production tubing. A bridge type valve may be combined with a movable restrictor to form a selective flow control system within a tubular or tubing string. A main production valve (e.g., a pilot-operated valve) may be opened when high velocity gas from a subsurface formation moves through the movable restrictor, which, in some implementations, may include a movable plate restriction device. Bridge valves and movable restrictors may be used within flow control devices, but using a movable restrictor to selectively produce gas and restrict water production through a bridge valve may provide unique advantages in producing wells.

Example Well System

Figure 1:
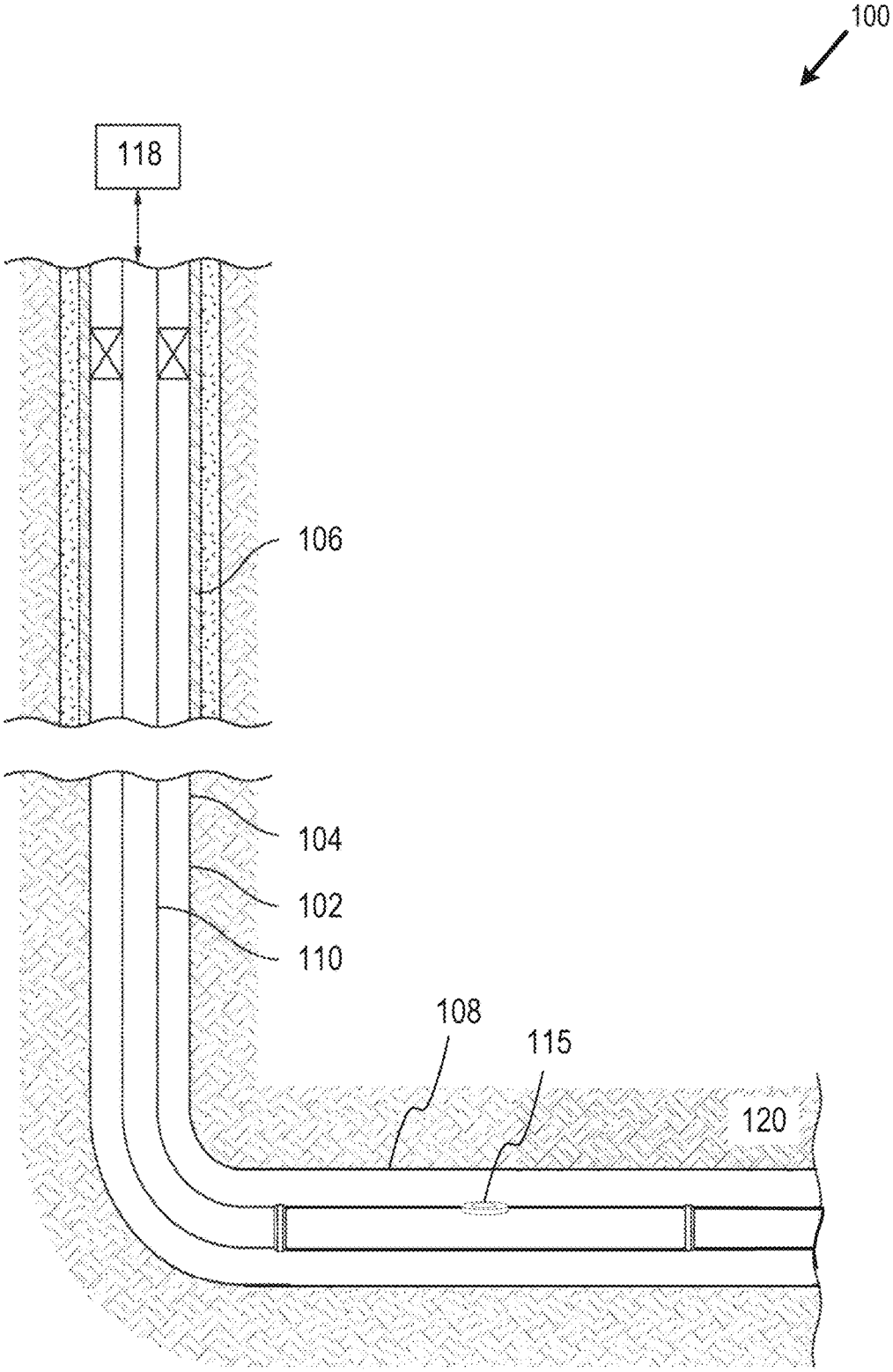
FIG. 1 is a longitudinal section depicting an example wellbore comprising a flow control valve, according to some implementations.

FIG. 1 is a longitudinal section depicting an example wellbore 102 comprising a flow control device 115, according to some implementations. A well system 100 may comprise the wellbore 102 which intersects a subsurface formation 120. The wellbore 102 may include a vertical section 104 (which is at least partially cemented with a casing string 106) and a horizontal section 108. The horizontal section 108 may be an open-hole section of the wellbore 102. Other wellbore configurations may also be suitable. A tubing string 110 may be coupled to surface equipment 118. The tubing string 110 may provide a conduit for formation fluids to travel from the subsurface formation 120 to the surface and for stimulation fluids to travel from the surface to the subsurface formation 120.

In some implementations, the flow control device 115 may be hydraulically coupled to an interior and exterior of the tubing string 110, although the flow control device 115 may be positioned elsewhere. The flow control device 115 may comprise one or more ports that allow fluids from the subsurface formation 120 into the flow control device 115. In some implementations, the flow control device 115 may include internal components such as a bridge valve, movable restrictor, and a pilot-operated valve that may selectively enable or halt flow through the flow control device. Fluids that are enabled to flow through the flow control device 115 may then enter the tubing string 110. The flow control device 115 is discussed with further detail in FIGS. 2-3.

In some implementations, at least one of the flow control device 115 may be used with one or more well screens and one or more packers. The packers may be configured to seal off an annulus defined between tubing string 110 and the wellbore 102. As a result, fluids may be produced from multiple intervals of the subsurface formation 120 via isolated portions of the subsurface formation 120 between adjacent pairs of packers.

In some implementations, a well screen and at least one of the flow control device 115 may be coupled to one another and positioned between a pair of packers. The well screen may include swell screens, wire wrap screens, mesh screens, sintered screens, expandable screens, pre-packed screens, treating screens, or other known screen types. In operation, the well screen may be configured to filter fluids flowing into the tubing string 110 from the subsurface formation 120. The flow control device 115 may be configured to restrict or otherwise regulate the flow of fluids into the tubing string 110 based on certain physical characteristics of the fluids.

The flow control device 115 may be an autonomous flow control device. The autonomous flow control device may utilize fluid dynamics to attenuate the flow of unwanted fluids such as water and other liquids into the interior of tubing string 110. The autonomous flow control device may operate as a passive flow control device, not requiring operator intervention. In examples, the operator may be defined as an individual, group of individuals, or an organization. The autonomous flow control device may be any suitable shape. A suitable shape may include, but is not limited to, cross-sectional shapes that are circular, elliptical, triangular, rectangular, square, hexagonal, and/or combinations thereof. The autonomous flow control device may be made from any suitable material. Suitable materials may include, but are not limited to, metals, nonmetals, polymers, ceramics, and/or combinations thereof. The autonomous flow control device may be made from tungsten carbide and/or steel.

It will be appreciated that well system 100 is merely one example of a wide variety of well systems in which the principles of this disclosure may be utilized. Accordingly, it should be understood that the principles of this disclosure are not necessarily limited to any of the details of the depicted well system 100, or the various components thereof, depicted in the drawings or otherwise described herein. For example, it is not necessary in keeping with the principles of this disclosure for wellbore 102 to include a generally vertical section 104 or a generally horizontal section 108. Moreover, it is not necessary for fluids to be only produced from subsurface formation 120 since, in other examples, fluids may be injected into subsurface formation 120, or fluids may be both injected into and produced from subsurface formation 120, without departing from the scope of the disclosure.

Example Flow Control Device

Figure 2:
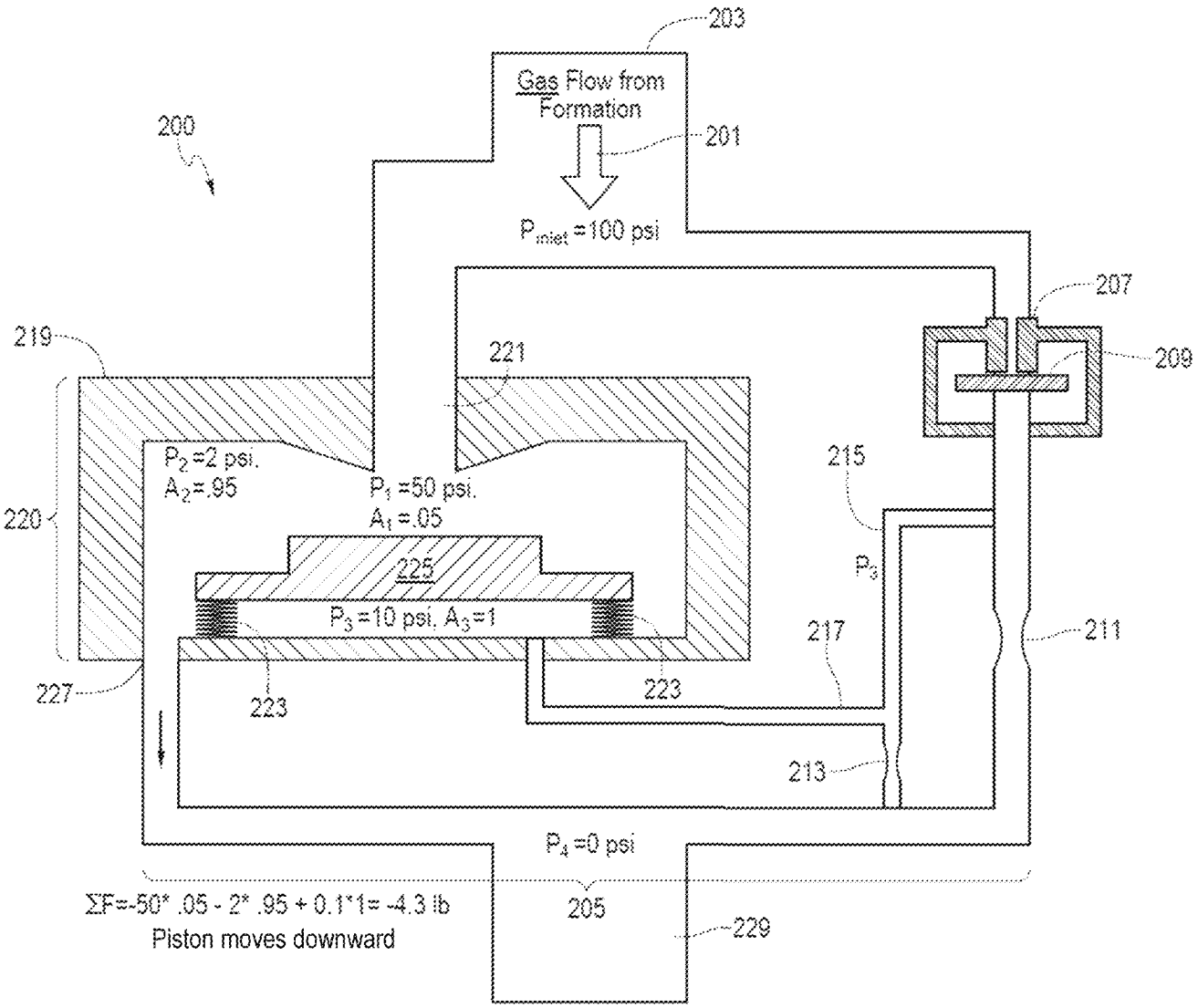
FIG. 2 is a cross section depicting a flow control device experiencing gas flow, according to some implementations.
Figure 3:
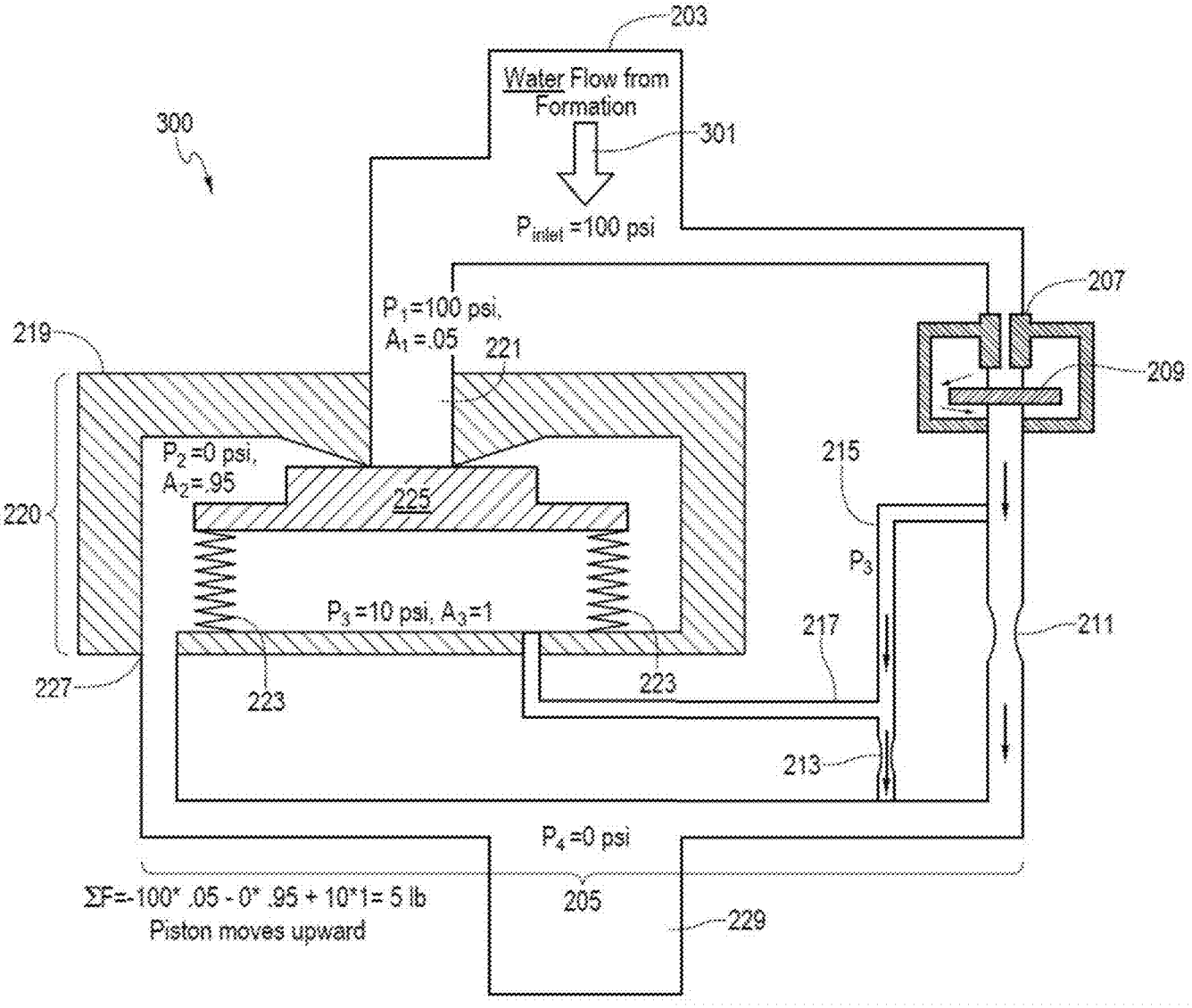
FIG. 3 is a cross section depicting a flow control device experiencing liquid flow, according to some implementations.

FIGS. 2 and 3 are longitudinal sections of depicting an example flow control device configured to attenuate liquid flow (water, oil, etc.) and enable gas flow. The example flow control device in FIGS. 2-3 may be similar to the flow control device 115 of FIG. 1.

FIG. 2 is a cross section depicting a flow control device 200 experiencing gas flow, according to some implementations. A gas flow 201 from a subsurface formation may enter an inlet 203 of the flow control device 200. The gas flow 201 may enter the inlet 203 at an inlet pressure and an inlet velocity. In some implementations, the flow control device 200 may comprise a bridge valve 205 including two parallel flow paths, and a portion of the gas flow 201 may split as it enters the bridge valve 205. At least a portion of the gas flow 201 may enter a movable restrictor housing 207 comprising a movable restrictor 209. In some implementations, the movable restrictor may comprise a movable restriction plate configured to move within the movable restrictor housing 207. The movable restrictor 209 may be configured to move axially and may be rotationally stabilized or fixed within the movable restrictor housing 207. In some implementations, the movable restrictor housing 207 may comprise a cylindrical interior. In some implementations, the movable restrictor housing 207 may include one or more internal guides, grooves, etc. configured to rotationally fix the movable restrictor as it moves laterally within the movable restrictor housing 207. The movable restrictor 209 may be in the shape of a plate, a disc, or any suitable shape within the movable restrictor housing 207. In some implementations, the movable restrictor 209 may have a continuous surface area, while, in other implementations, the movable restrictor 209 may include one or more holes, vents, and/or ports.

In some implementations, the movable restrictor may include one or more extensions configured to align and partially reside within the internal grooves and/or guides of the movable restrictor housing 207. The internal grooves of the movable restrictor housing 207 and the extensions of the movable restrictor 209 may be configured to limit rotational movement of the movable restrictor 209 during actuation. During steady-state flow, the movable restrictor 209 may be a quasi-static restrictor configured to remain stationary until properties of fluid at the inlet 203 change. For example, the movable restrictor 209 (configured as a quasi-static restrictor) may remain stationary when the flow rate and flow composition (liquid and gas composition(s)) through the movable restrictor housing 207 is steady, but the movable restrictor 209 may physically move when the flow rate and/or the flow composition change.

In some implementations, the velocity of the gas flow 201 may increase as the gas flow contacts the movable restrictor 209. The gas flow 201 may exhibit a Bernoulli effect on the movable restrictor 209. A gas, such as natural gas and/or other vapors originating from one or more subsurface formations, may comprise a low viscosity and may enter the movable restrictor housing 207 at a high velocity. As linear flow entering the movable restrictor housing 207 turns into radial flow as the gas flow 201 contacts the movable restrictor 209, a region of low pressure may develop near the inlet of the movable restrictor housing 207. This low pressure region may induce a lifting force on the movable restrictor 209, substantially holding (e.g., gripping, suctioning, etc. via the Bernoulli principle) the movable restrictor 209 to the inlet of the movable restrictor housing 207. Thus, the movable restrictor 209 may axially move from an open position to a closed position under high velocity gas flow, such as the gas flow 201, via the Bernoulli effect. The "closed position" may be defined as the movable restrictor 209 substantially attenuating bulk fluid entry into the movable restrictor housing 207—i.e., the closed position may refer to the movable restrictor 209 being substantially or partially closed and not fully sealed. A portion of the gas flow 201 may flow over and past the movable restrictor 209 to maintain the Bernoulli effect. Thus, when the movable restrictor 209 is in the closed position, some of the gas flow 201 may still pass through the movable restrictor housing 207, but a majority of the gas flow 201 may be directed elsewhere. Because the gas flow 201 enters the movable restrictor housing 207 substantially linearly, buoyancy forces on the movable restrictor 209 may operate with a lower centripetal acceleration (e.g., at ~1 g (9.8 $m/s^2$)) than vortical devices. Utilizing an axially-configured movable restrictor such as the movable restrictor 209 may avoid high g-forces generated by centripetal acceleration, enabling smoother linear travel of the movable restrictor 209 as it moves to and from the closed and open positions. This may also extend the lifespan of the flow control device 200.

When the movable restrictor 209 is moved from the open position to the closed position, a portion of the gas flow 201 from the subsurface formation may exit the movable restrictor housing 207 and enter a fluidic restriction 211. In some implementations, the fluidic restriction 211 may comprise a nozzle, a tubing, a vortex, a conduit of a smaller diameter than that of the bridge valve 205, or any suitable passage. Some of the gas flow 201 may enter a conduit 215 including a fluidic restriction 213. In some implementations, the fluidic restriction 213 may be similar to the fluidic restriction 211. The fluidic restriction 213 may be fluidically coupled to a control line 217, and the control line 217 may be fluidically coupled to a pilot-operated valve 220. In some implementations, the fluidic restrictions 211, 213 may be coupled to an outlet 229 of the flow control device 200, and a portion of the gas flow 201 may flow to the outlet 229.

In some implementations, the pilot-operated valve 220 (as depicted) may instead be replaced by another type of fluidic valve. For example, the pilot-operated valve 220 may instead comprise a shuttle valve, an inverse shuttle valve, a ball valve, a diaphragm shuttle valve, a bellows valve, other pilot-operated valve configurations, a pilot-operated check valve, and/or more. The valve 220 may be any suitable size, height, and/or shape.

The pilot-operated valve 220 may be coupled to the inlet 203 and may comprise an inlet restriction 221. In some implementations, the inlet restriction 221 may be any of a nozzle, a vortex, a change in tubing and/or pipe diameter, fluid diode, etc. The pilot-operated valve 220 may include a pilot-operated valve housing 219 and a piston 225. In some implementations, the piston 225 may reside within a piston seat. In some implementations, the piston 225 may comprise a smaller surface area on a top side and a larger surface area on a bottom side.

The piston 225 may be coupled to the pilot-operated valve housing 219 via one or more bellows 223. In some implementations, the piston 225 and bellows 223 may together be referred to as a bellow seal. The bellows 223 may be any suitable size, height, material, and/or shape and may comprise walls that expand and/or compress when acted upon by fluidic pressure(s) (such as a differential pressure in the pilot-operated valve 220). For example, the bellows 223 may be comprised of one or more metals, a rubber diaphragm, one or more pistons coupled to one or more O-rings, etc. In some implementations, one or more springs may be included within an interior of the pilot-operated valve housing 219 and configured to engage with a top side of the piston 225. The one or more springs may be utilized with any suitable bellows configurations. The one or more springs may induce the pilot-operated valve 220 to be a normally-open valve.

The bellows 223 may couple the piston 225 onto an internal wall of the pilot-operated valve housing 219 through the use of any suitable mechanisms, including, but not limited to, the use of suitable fasteners, threading, adhesives, welding, and/or combinations thereof. The suitable fasteners may include nuts and bolts, washers, screws, pins, sockets, rods and studs, hinges and/or any combination thereof. In some implementations, fluid under the piston 225 may exit the pilot-operated valve 220 through the control line 217 and the fluidic restriction 213 when the bellows 223 are compressed.

The piston 225 may be configured to move linearly within the pilot-operated valve 220, depending on a differential pressure experienced by the piston 225 and on whether the movable restrictor 209 is in an open or closed position. When the movable restrictor 209 is in the closed position, as depicted in FIG. 2, a pressure experienced by the bellows may be reduced, and the piston 225 (and by extension, the pilot-operated valve 220) may remain in an open position or be actuated from a closed position to the open position. In some implementations, the pilot-operated valve 220 may be a normally-open valve. A force summation depicting a differential pressure experienced by the bellows 223 (and piston 225) during an example flow scenario (for both gas and liquid) is described by Equation 1:

$$\sum F = (-P_1 * A_1) + (-P_2 * A_2) + (P_3 * A_3) \quad \text{Eq. (1)}$$

where $P_1$ is a high pressure exerted by the gas flow 201 at the inlet restriction 221, $A_1$ is a surface area of a top side of the piston 225 that is directly contacted by the gas flow 201 as it travels through the inlet restriction 221, $P_2$ is a residual pressure exerted by the gas flow 201 on $A_2$, where $A_2$ is the surface area of the top side of piston 225 indirectly contacted (i.e., the remaining area which may, in some implementations, be an annular area) by the gas flow 201, where $P_3$ is a pressure exerted by a fluid passing through the movable restriction housing 207, and $A_3$ is a surface area of the bottom of the piston 225. $A_3$ may be substantially larger than $A_1$, but in a gas flow scenario, $P_1$ may substantially exceed $P_3$. In some implementations, a tubing pressure, $P_4$, may describe a pressure at the outlet 229 and/or a pressure of a production tubing, and an inlet pressure, $P_{inlet}$, may describe a pressure at the inlet 203.

The following is an example of Equation 1 and the values used to compute the net force exerted on the bellows 223 when experiencing gas flow. Pressures are represented in pounds per square inch (psi), areas may be represented by square inches: $P_1$=50 psi, $A_1$=0.05 in$^2$, $P_2$=2 psi, $A_2$=0.95 in$^2$, $P_3$=0.1 psi, $A_3$=1 in$^2$. The sum of the force on the bellows 223 is below:

$$\sum F = (-50\ psi * 0.05\ \text{in}^2) + (-2\ psi * 0.95\ \text{in}^2) + (0.1\ psi * 1\ \text{in}^2) = -4.3\ \text{pounds (lb.)}$$

Therefore, the piston 225 moves downward.

As depicted in FIG. 2, the movable restrictor 209 is in the closed position. The movable restrictor in the closed position attenuates the gas flow 201 through the movable restrictor housing 207. Because of this, $P_3$ may be smaller than $P_1$. Thus, the bellows 223 may experience a negative differential pressure, and the pilot-operated valve 220 may remain in an open position. When the pilot-operated valve 220 is in the open position, the pilot-operated valve 220 may enable a majority of the gas flow 201 to pass through the flow control device 200. The gas flow 201 may pass through an outlet 227 of the pilot-operated valve 220. The gas flow 201 may then exit the outlet 229 of the flow control device 200 and be produced via a production tubing or similar conduit.

FIG. 3 is a cross section depicting a flow control device 300 experiencing liquid flow, according to some implementations. The flow control device 300 depicted in FIG. 3 may comprise identical components as those depicted in FIG. 2 but in different configurations/positions (as induced by a liquid flow scenario). For example, the flow control device 300 may include the bridge valve 205, the inlet 203, the inlet restriction 221, the pilot-operated valve 220, the pilot-operated valve housing 219, the outlet 227, the movable restrictor housing 207, the movable restrictor 209, the conduit 215, the control line 217, the fluidic restriction 211, the fluidic restriction 213, and the outlet 229.

In FIG. 3, a liquid flow 301 may enter the flow control device 300 from a subsurface formation. The liquid flow 301 may include water, oil, another subsurface fluid in the liquid phase, and/or any combination thereof. In some implementations, the liquid flow 301 may induce a similar inlet pressure at the inlet 203 as the gas flow 201. However, the liquid flow 301 may enter the flow control device 300 at a lower velocity than the gas flow 201. The liquid flow 301 may also have higher viscosity than the gas flow 201.

As the liquid flow 301 enters the bridge valve 205 and contacts the movable restrictor 209, the liquid flow 301 does not exhibit a Bernoulli effect on the movable restrictor 209. In contrast, the liquid flow 301 at the lower velocity and higher viscosity displaces the movable restrictor from the closed position to an open position. In some implementations, when a gas flow 201 is interrupted or followed by a liquid flow 301, the movable restrictor 209 may lose its Bernoulli grip and drop once the liquid flow 301 contacts the movable restrictor 209.

When the movable restrictor 209 is in the open position, it enables a higher rate of the liquid flow 301 to pass through the movable restrictor housing 207 than the gas flow 201. From the movable restrictor housing 207, the liquid flow 301 may enter the conduit 215 and control line 217. In some implementations, the conduit 215 and control line 217 may be of a smaller diameter than the main flow passages of the bridge valve 205. In other implementations, at least one of the conduit 215 and control line 217 may comprise a nozzle or similar fluidic restriction to increase a pressure of the liquid flow 301. Thus, a fluidic pressure of the liquid flow 301 may increase as it enters and travels through the conduit 215 and control line 217. The increased fluidic pressure from the liquid flow 301 within the control line 217 may generate a positive differential pressure under the piston 225 and on the bellows 223. With reference to Equation 1. $P_3$ in the flow control device 300 may be larger than in the flow control device 200 when the movable restrictor 209 is in the open position. Thus, in the liquid flow scenario, $P_3$ applied to $A_3$ of the piston 225 may be greater than $P_1$ applied to $A_1$ as a portion of the liquid flow 301 enters the inlet restriction 221, where $P_1$ is supplied by the subsurface formation.

The following is an example of Equation 1 and the values used to compute the net force exerted on the bellows 223 when experiencing liquid flow. Pressures are represented in pounds per square inch (psi), areas may be represented by square inches: $P_1$=100 psi, $A_1$=0.05 in$^2$, $P_2$=0 psi, $A_2$=0.95 in$^2$. $P_3$=10 psi, $A_3$=1 in$^2$. The sum of the force on the bellows 223 is below:

$$\sum F = (-100\ psi * 0.05\ \text{in}^2) + (0\ psi * 0.95\ \text{in}^2) + (10\ psi * 1\ \text{in}^2) = 5\ \text{lb}.$$

Therefore, the piston 225 moves upward.

As shown above, the positive differential pressure may expand the bellows 223, and the piston 225 may be actuated upward to engage with the pilot-operated valve housing 219, significantly reducing flow through the pilot-operated valve 220 (and the bridge valve 205). This is the closed position of the pilot-operated valve 220. When the pilot-operated valve 220 is actuated to the closed position by the positive differential pressure on the bellows 223, liquid production through the bridge valve 205 (and therefore, the flow control device 300) may be attenuated. Thus, the flow control devices 200, 300 are flow devices configured to enable gas production and restrict liquid production.

Example Flowchart

Figure 4:
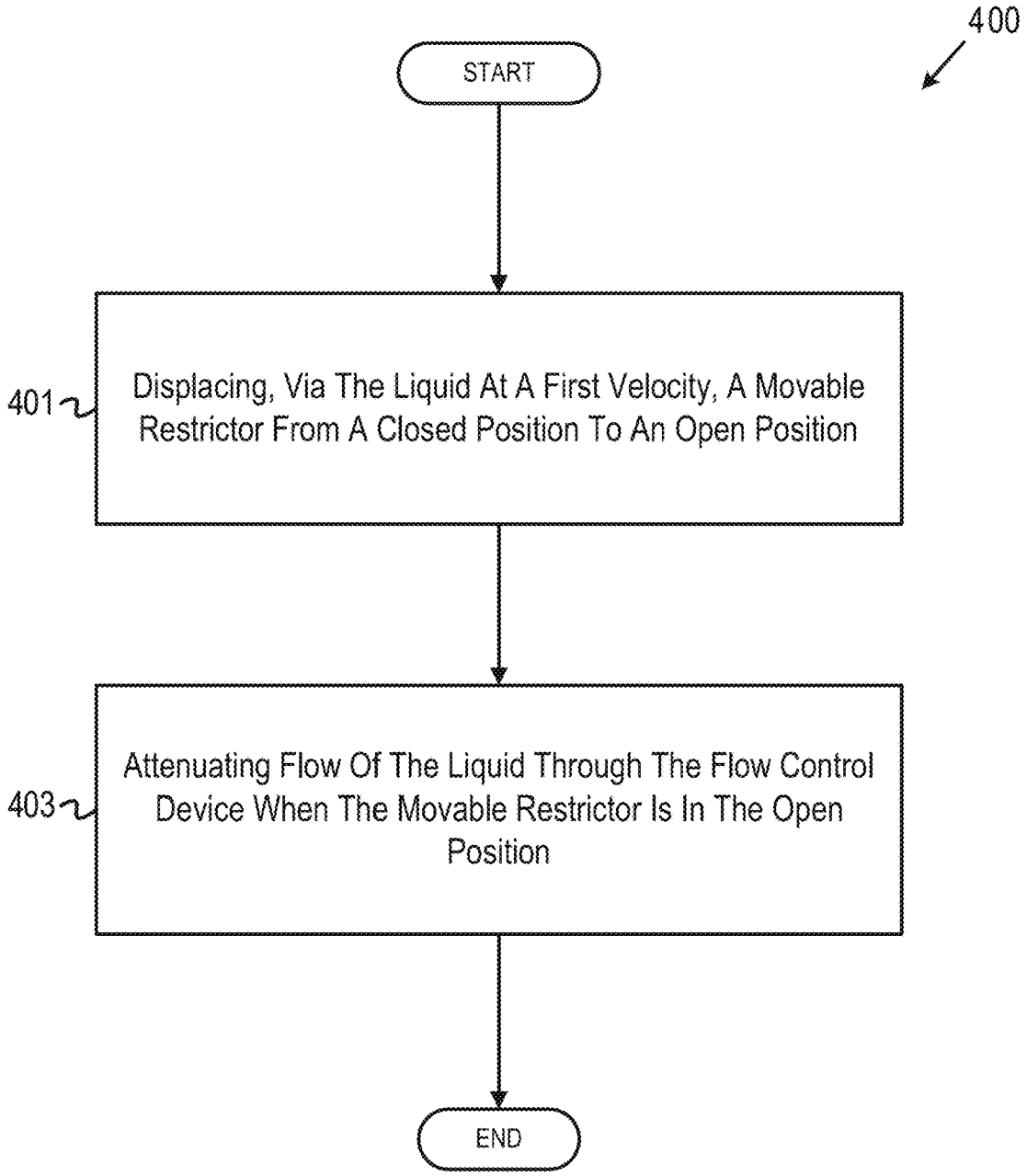
FIG. 4 is a flowchart depicting example operations for selective fluid production, according to some implementations.

FIG. 4 is a flowchart depicting a method 400 producing a liquid or a gas from a flow control device positioned in a tubular within a wellbore formed in a subsurface formation, according to some implementations. Operations of the method 400 may be performed by any combination of hardware or hardware systems. Such operations are described with reference to FIGS. 1-3. However, such operations may be performed by other systems or components. The operations of the method 400 begin at block 401.

At block 401, the method 400 includes displacing, via the liquid at a first velocity, a movable restrictor from a closed position to an open position. For example, with reference to FIG. 3, the movable restrictor 209 may be displaced from the closed position to the open position by a liquid flow 301. In some implementations, the lower velocity of the liquid flow 301 may interrupt a Bernoulli effect exhibited by the gas flow 201 on the movable restrictor 209, thus causing the movable restrictor 209 to drop. Flow progresses to block 403.

At block 403, the method 400 includes attenuating flow of the liquid through the flow control device when the movable restrictor is in the open position. For example, with reference to FIG. 3, the pilot-operated valve 220 may be actuated to a closed position because of a positive differential pressure enacted on the bellows 223 and piston 225. When the pilot-operated valve 220 is shut/in the closed position, the pilot-operated valve 220 may attenuate a bulk of the liquid flow 301 from progressing through the outlet 229 and into a production tubing or similar conduit. Flow of the method 400 ceases.

While the aspects of the disclosure are described with reference to various implementations and exploitations, it will be understood that these aspects are illustrative and that the scope of the claims is not limited to them. In general, techniques for selectively producing fluids via an autonomous flow control device as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

Example Implementations

Implementation #1: A flow control device positioned in a tubing string within a wellbore formed in a subsurface formation and configured to produce a liquid or a gas, the flow control device comprising: a movable restrictor configured to move, in response to the liquid at a first velocity from the subsurface formation, from a closed position to an open position; and a pilot-operated valve configured to attenuate a flow of the liquid through the flow control device when the movable restrictor is in the open position.

Implementation #2: The flow control device of Implementation 1, wherein the movable restrictor is configured to move, in response to the gas at a second velocity from the subsurface formation, from the open position to the closed position, and wherein the pilot-operated valve is configured to enable a flow of the gas through the flow control device when the movable restrictor is in the closed position.

Implementation #3: The flow control device of any one or more of Implementations 1-2, wherein the flow control device includes a bridge valve, wherein the bridge valve is fluidically coupled to the pilot-operated valve.

Implementation #4: The flow control device of any one or more of Implementations 1-3, further configured to: generate, via the movable restrictor in the closed position, a negative differential pressure on a bellow seal within the pilot-operated valve; and actuate, via the negative differential pressure, the pilot-operated valve to an open position, wherein the pilot-operated valve in the open position enables the flow of the gas through the bridge valve, wherein the pilot-operated valve is a normally-open valve.

Implementation #5: The flow control device of any one or more of Implementations 1-4, further configured to: generate, via the movable restrictor in the open position, a positive differential pressure on a bellow seal within the pilot-operated valve; and actuating, via the positive differential pressure, the pilot-operated valve to a closed position, wherein the pilot-operated valve in the closed position attenuates the flow of the liquid through the bridge valve.

Implementation #6: The flow control device of any one or more of Implementations 1-5, further comprising: a first fluidic restriction positioned at an inlet of the pilot-operated valve; a second fluidic restriction coupled to an outflow of the movable restrictor; and a third fluidic restriction coupled to the outflow of the movable restrictor and to the pilot-operated valve.

Implementation #7: The flow control device of any one or more of Implementations 1-6, wherein the first, second, and third fluidic restrictions comprise one of a nozzle, a conduit, a vortex, and a tubular.

Implementation #8: A selective flow control system positioned in a wellbore formed in a subsurface formation and configured to produce a liquid or a gas, the selective flow control system comprising: a tubing string comprising at least a first tubular positioned in the wellbore; a flow control device hydraulically coupled with an interior and an exterior of the tubing string, the flow control device comprising: a movable restrictor configured to move, in response to the liquid at a first velocity from the subsurface formation, from a closed position to an open position; and a pilot-operated valve configured to attenuate a flow of the liquid through the flow control device when the movable restrictor is in the open position.

Implementation #9: The selective flow control system of Implementation 8, wherein the movable restrictor is configured to move, in response to the gas at a second velocity from the subsurface formation, from the open position to the closed position, and wherein the pilot-operated valve is configured to enable a flow of the gas through the flow control device when the movable restrictor is in the closed position.

Implementation #10: The selective flow control system of any one or more of Implementations 8-9, wherein the flow control device includes a bridge valve, wherein the bridge valve is fluidically coupled to the pilot-operated valve.

Implementation #11: The selective flow control system of any one or more of Implementations 8-10, further configured to: generate, via the movable restrictor in the closed position, a negative differential pressure on a bellow seal within the pilot-operated valve; and actuate, via the negative differential pressure, the pilot-operated valve to an open position, wherein the pilot-operated valve in the open position enables the flow of the gas through the bridge valve, wherein the pilot-operated valve is a normally-open valve.

Implementation #12: The selective flow control system of any one or more of Implementations 8-11, further configured to: generate, via the movable restrictor in the open position, a positive differential pressure on a bellow seal within the pilot-operated valve; and actuating, via the positive differential pressure, the pilot-operated valve to a closed position, wherein the pilot-operated valve in the closed position attenuates the flow of the liquid through the bridge valve.

Implementation #13: The selective flow control system of any one or more of Implementations 8-12, further comprising: a first fluidic restriction positioned at an inlet of the pilot-operated valve; a second fluidic restriction coupled to an outflow of the movable restrictor; and a third fluidic restriction coupled to the outflow of the movable restrictor and to the pilot-operated valve.

Implementation #14: The selective flow control system of any one or more of Implementations 8-13, wherein the first, second, and third fluidic restrictions comprise one of a nozzle, a conduit, a vortex, and a second tubular.

Implementation #15: A method for producing a liquid or a gas from a flow control device positioned in a tubular within a wellbore formed in a subsurface formation, the method comprising: displacing, via the liquid at a first velocity, a movable restrictor from a closed position to an open position; and attenuating flow of the liquid through the flow control device when the movable restrictor is in the open position.

Implementation #16: The method of Implementation 15, further comprising: displacing, via the gas at a second velocity, the movable restrictor from the open position to the closed position; and enabling flow of the gas through the flow control device when the movable restrictor is in the closed position.

Implementation #17: The method of any one or more of Implementations 15-16, wherein the flow control device includes a bridge valve, wherein the bridge valve is fluidically coupled to a pilot-operated valve.

Implementation #18: The method of any one or more of Implementations 15-17, wherein attenuating the flow of the liquid includes: actuating, via the movable restrictor, the pilot-operated valve from an open position to a closed position.

Implementation #19: The method of any one or more of Implementations 15-18, wherein enabling the flow of the gas comprises: generating, via the movable restrictor in the closed position, a negative differential pressure on a bellow seal within the pilot-operated valve; and actuating, via the negative differential pressure, the pilot-operated valve to an open position, wherein the pilot-operated valve in the open position enables the flow of the gas through the bridge valve, wherein the pilot-operated valve is a normally-open valve.

Implementation #20: The method of any one or more of Implementations 15-19, wherein attenuating the flow of the liquid comprises: generating, via the movable restrictor in the open position, a positive differential pressure on a bellow seal within the pilot-operated valve; and actuating, via the positive differential pressure, the pilot-operated valve to a closed position, wherein the pilot-operated valve in the closed position attenuates the flow of the liquid through the bridge valve.

What is claimed is:

1. A flow control device to be positioned in a tubing string within a wellbore formed in a subsurface formation, the flow control device comprising:

a movable restrictor configured to move within a housing positioned in a first flow path of the flow control device, wherein the housing includes a housing inlet and a housing outlet, wherein the movable restrictor is configured to move toward the housing inlet upon receiving a gas flow and move toward the housing outlet upon receiving a liquid flow; and a pilot-operated valve positioned in a second flow path of the flow control device and configured to control a majority of fluid flow through the flow control device based, at least in part, on the position of the movable restrictor within the housing.

2. The flow control device of claim 1, wherein the movable restrictor is configured to move, in response to the liquid flow at a first velocity, from a closed position to an open position, wherein the movable restrictor is configured to move, in response to the gas flow at a second velocity, from the open position to the closed position, and wherein the pilot-operated valve is configured to enable a flow of gas through the flow control device when the movable restrictor is in the closed position.

3. The flow control device of claim 1, wherein the flow control device includes a bridge valve, wherein the bridge valve is fluidically coupled to the pilot-operated valve.

4. The flow control device of claim 1, further configured to:

generate, via the movable restrictor in a closed position, a negative differential pressure on a bellow seal within the pilot-operated valve; and actuate, via the negative differential pressure, the pilot-operated valve to an open position, wherein the pilot-operated valve in the open position enables a flow of gas through the flow control device.

5. The flow control device of claim 1, further configured to:

generate, via the movable restrictor in an open position, a positive differential pressure on a bellow seal within the pilot-operated valve; and actuating, via the positive differential pressure, the pilot-operated valve to a closed position, wherein the pilot-operated valve in the closed position attenuates a flow of liquid through the flow control device.

6. The flow control device of claim 1, further comprising:

a third flow path to hydraulically couple an outflow of the movable restrictor and the pilot-operated valve;

a first fluidic restriction positioned at an inlet of the pilot-operated valve;

a second fluidic restriction coupled to the outflow of the movable restrictor; and a third fluidic restriction coupled to the third flow path.

7. The flow control device of claim 6, wherein the first, second, and third fluidic restrictions comprise one of a nozzle, a conduit, a vortex, and a tubular.

8. A selective flow control system to be positioned in a wellbore formed in a subsurface formation, the selective flow control system comprising:

a tubing string comprising at least a first tubular to be positioned in the wellbore;

a flow control device to be hydraulically coupled with an interior and an exterior of the tubing string, the flow control device comprising:

a movable restrictor configured to move within a housing positioned in a first flow path of the flow control device, wherein the housing includes a housing inlet and a housing outlet, wherein the movable restrictor is configured to move toward the housing inlet upon receiving a gas flow and move toward the housing outlet upon receiving a liquid flow; and a pilot-operated valve positioned in a second flow path of the flow control device and configured to control a majority of fluid flow through the flow control device based, at least in part, on the position of the movable restrictor within the housing.

9. The selective flow control system of claim 8, wherein the movable restrictor is configured to move, in response to the liquid flow at a first velocity, from a closed position to an open position, wherein the movable restrictor is configured to move, in response to the gas flow at a second velocity, from the open position to the closed position, and wherein the pilot-operated valve is configured to enable a flow of gas through the flow control device when the movable restrictor is in the closed position.

10. The selective flow control system of claim 8, wherein the flow control device includes a bridge valve, wherein the bridge valve is fluidically coupled to the pilot-operated valve.

11. The selective flow control system of claim 8, further configured to:

generate, via the movable restrictor in a closed position, a negative differential pressure on a bellow seal within the pilot-operated valve; and actuate, via the negative differential pressure, the pilot-operated valve to an open position, wherein the pilot-operated valve in the open position enables a flow of gas through the flow control device.

12. The selective flow control system of claim 8, further configured to:

generate, via the movable restrictor in an open position, a positive differential pressure on a bellow seal within the pilot-operated valve; and actuating, via the positive differential pressure, the pilot-operated valve to a closed position, wherein the pilot-operated valve in the closed position attenuates a flow of liquid through the flow control device.

13. The selective flow control system of claim 8, further comprising:

a third flow path to hydraulically couple an outflow of the movable restrictor and the pilot-operated valve;

a first fluidic restriction positioned at an inlet of the pilot-operated valve;

a second fluidic restriction coupled to the outflow of the movable restrictor; and a third fluidic restriction coupled to the third flow path.

14. The selective flow control system of claim 13, wherein the first, second, and third fluidic restrictions comprise one of a nozzle, a conduit, a vortex, and a second tubular.

15. A method for producing a liquid or a gas from a flow control device to be positioned in a tubular within a wellbore formed in a subsurface formation, the method comprising:

displacing a movable restrictor configured to move within a housing positioned in a first flow path of the flow control device, wherein the housing includes a housing inlet and a housing outlet, wherein the movable restrictor is configured to move toward the housing inlet upon receiving a gas flow and move toward the housing outlet upon receiving a liquid flow; and controlling, via a pilot-operated valve positioned in a second flow path of the flow control device, a majority of fluid flow through the flow control device based, at least in part, on the position of the movable restrictor within the housing.

16. The method of claim 15, further comprising:

displacing, via the gas at a first velocity, the movable restrictor from an open position to a closed position; and enabling flow of the gas through the flow control device when the movable restrictor is in the closed position.

17. The method of claim 15, wherein the flow control device includes a bridge valve, wherein the bridge valve is fluidically coupled to the pilot-operated valve, and wherein the pilot-operated valve is hydraulically coupled to an outflow of the movable restrictor via a third flow path.

18. The method of claim 15, further comprising:

displacing, via the liquid at a second velocity, the movable restrictor from a closed position to an open position; and attenuating the liquid flow through the pilot-operated valve when the movable restrictor is in the open position, wherein attenuating the liquid flow through the pilot-operated valve comprises actuating, via the movable restrictor, the pilot-operated valve from an open position to a closed position.

19. The method of claim 15, further comprising:

generating, via the movable restrictor in a closed position, a negative differential pressure on a bellow seal within the pilot-operated valve; and actuating, via the negative differential pressure, the pilot-operated valve to an open position, wherein the pilot-operated valve in the open position enables a flow of the gas through the flow control device.

20. The method of claim 15, further comprising:

generating, via the movable restrictor in an open position, a positive differential pressure on a bellow seal within the pilot-operated valve; and actuating, via the positive differential pressure, the pilot-operated valve to a closed position, wherein the pilot-operated valve in the closed position attenuates a flow of the liquid through the flow control device.

* * * * *